US011787184B2

(12) United States Patent
Tanaka et al.

(10) Patent No.: US 11,787,184 B2
(45) Date of Patent: Oct. 17, 2023

(54) RECORDING APPARATUS

(71) Applicant: CANON KABUSHIKI KAISHA, Tokyo (JP)

(72) Inventors: Yusuke Tanaka, Kanagawa (JP); Muneharu Fujikawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 111 days.

(21) Appl. No.: 17/459,490

(22) Filed: Aug. 27, 2021

(65) Prior Publication Data

US 2022/0063277 A1 Mar. 3, 2022

(30) Foreign Application Priority Data

Sep. 1, 2020 (JP) ..... 2020-147155

(51) Int. Cl.
*B41J 2/165* (2006.01)

(52) U.S. Cl.
CPC ..... *B41J 2/16505* (2013.01); *B41J 2/16523* (2013.01); *B41J 2/16508* (2013.01)

(58) Field of Classification Search
CPC . B41J 2/16505; B41J 2/16523; B41J 2/16508
See application file for complete search history.

(56) References Cited

U.S. PATENT DOCUMENTS 9,061,503 B2 * 6/2015 Shinkai ..... B41J 2/16523

FOREIGN PATENT DOCUMENTS

JP 2017081086 A 5/2017

* cited by examiner

*Primary Examiner* — Geoffrey S Mruk
(74) *Attorney, Agent, or Firm* — Canon U.S.A., Inc. I.P. Division

(57) ABSTRACT

A recording apparatus includes a recovery unit including a first cap configured to cap the first ejection port array and a second cap configured to cap the second ejection port array, a first tank configured to contain the first liquid to be supplied to the first ejection port array, a second tank that is arranged farther from the recovery unit than the first tank is to the recovery unit and that is configured to contain the second liquid to be supplied to the second ejection port array, a first atmosphere communication valve, a second atmosphere communication valve, and a control unit configured to, in a case where an instruction to transport the recording apparatus is input, perform control of opening the first atmosphere communication valve, and perform control of closing the second atmosphere communication valve.

11 Claims, 10 Drawing Sheets

RECORDING APPARATUS

BACKGROUND

Field of the Disclosure

The present disclosure relates to a recording apparatus that records an image.

Description of the Related Art

Japanese Patent Application Laid-Open No. 2017-081086 discusses a configuration of supplying ink to a recording head via a tube from an ink tank arranged on a front surface of an apparatus. Since the ink tank can contain a large amount of ink, a frequency of supplementing ink by a user can be reduced.

According to the configuration discussed in Japanese Patent Application Laid-Open No. 2017-081086, however, a recording apparatus, when transported in a state where ink is contained in the ink tank, may be held in an inclined state. In this case, ink contained in the ink tank may travel to the recording head via the tube due to a surface level difference generated between a liquid surface of ink in the ink tank and an ejection port surface of the recording head, and the ink may leak from the recording head.

SUMMARY

The present disclosure has been made in view of the above issues, and aspects of the disclosure are directed to reduction of leakage of a liquid from an apparatus.

According to an aspect of the present disclosure, a recording apparatus includes a first recording head including a first ejection port array configured to eject a first liquid, a second recording head including a second ejection port array configured to eject a second liquid, a recovery unit including a first cap configured to cap the first ejection port array and a second cap configured to cap the second ejection port array, a first tank configured to contain the first liquid to be supplied to the first ejection port array, a second tank that is arranged farther from the recovery unit than the first tank is to the recovery unit and that is configured to contain the second liquid to be supplied to the second ejection port array, a first atmosphere communication valve configured to switch a communicating state between an inside of the first cap and an atmosphere, a second atmosphere communication valve configured to switch a communicating state between an inside of the second cap and an atmosphere, and a control unit configured to, in a case where an instruction to transport the recording apparatus is input, perform control of opening the first atmosphere communication valve and bringing the inside of the first cap into a communicating state of communicating with the atmosphere, and perform control of closing the second atmosphere communication valve and bringing the inside of the second cap into a non-communicating state of not communicating with the atmosphere.

Further features of the present disclosure will become apparent from the following description of exemplary embodiments with reference to the attached drawings.

DESCRIPTION OF THE EMBODIMENTS

A first exemplary embodiment of the present disclosure will be described below with reference to the accompanying drawings. In this regard, exemplary embodiments described below do not limit the present disclosure, and all combinations of features described in the exemplary embodiments are not necessarily essential to a means for solving the issues addressed by the present disclosure. In addition, relative arrangements, shapes, and the like of components described in the exemplary embodiments are merely examples, and are not intended to limit the scope of the present disclosure.

Figure 1:
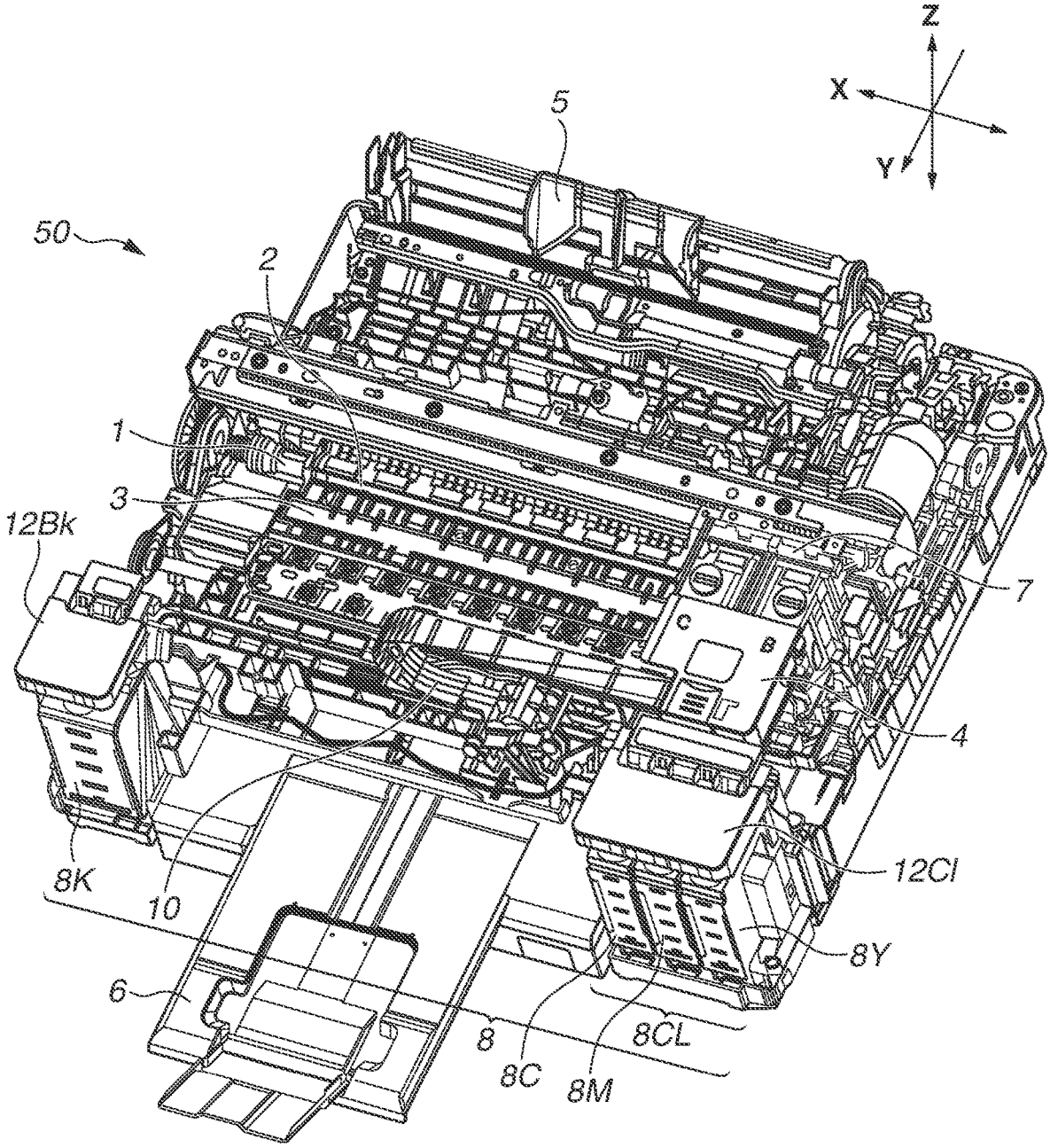
FIG. 1 is a perspective view illustrating an internal configuration of an ink jet recording apparatus according to a first exemplary embodiment.

FIG. 1 is a perspective view illustrating an internal configuration of an ink jet recording apparatus (hereinafter referred to as a recording apparatus) 50 according to the present exemplary embodiment. The recording apparatus 50 includes a recording head 4 and an ink tank 8. The recording head 4 performs a recording operation on a recording medium such as a sheet material. The ink tank 8 serves as an ink container that contains ink to be supplied to the recording head 4. In the present exemplary embodiment, the ink tank 8 is arranged on a front surface of the recording apparatus 50 and fixed to a main body of the recording apparatus 50. The recording apparatus 50 includes a cover, which is not illustrated. The cover is arranged on a housing and can open and close. FIG. 1 illustrates a state in which the cover is open. The cover, which is not illustrated, may include a scanner unit capable of reading a document.

The recording apparatus 50 separates one sheet from recording media loaded on a sheet feeding tray 5 arranged on a rear surface, and feeds the sheet by a not illustrated feeding roller, which serves as a feeding unit. The recording medium fed by the feeding roller is conveyed to a recording position facing the recording head 4 by a conveyance roller 1 and a pinch roller 2 driven by the rotation of the conveyance roller 1. The conveyance roller 1 and the pinch roller 2 serve as a conveyance unit.

The recording apparatus 50 further includes a platen 3 at a position facing the recording head 4, and the rear surface of the recording medium conveyed to the recording position is supported by the platen 3. The recording head 4 performs recording on the recording medium based on data at the recording position. The recording medium on which recording by the recording head 4 has been completed is discharged onto a sheet discharge tray 6 by a discharge roller, which is not illustrated.

In the present exemplary embodiment, a direction in which the recording medium is conveyed by the conveyance unit (a Y-direction illustrated in FIG. 1) is referred to as a conveyance direction. That is, an upstream side of the conveyance direction corresponds to a rear surface side of the recording apparatus 50, and a downstream side of the conveyance direction corresponds to a front surface side of the recording apparatus 50. Further, an upper side in the gravitational direction is referred to as a Z-direction.

The recording head 4 is mounted on a carriage 7 that reciprocally moves in a main-scanning direction (X-direction illustrated in FIG. 1) crossing the conveyance direction. In the present exemplary embodiment, the conveyance direction (Y-direction) and the main-scanning direction (X-direction) are orthogonal to each other. The recording head 4 ejects ink droplets while moving in the main-scanning direction together with the carriage 7, and records an image of a predetermined length (corresponding to one band) on a recording medium (a recording operation). When the image corresponding to one band is recorded, the recording medium is conveyed by a predetermined amount by the conveyance roller 1 and the pinch roller 2 (an intermittent conveyance operation). By repeating the recording operation for one band and the intermittent conveyance operation, the recording apparatus 50 records an image on the entire recording medium based on image data.

In addition, the recording head 4 according to the present exemplary embodiment includes a generating unit that generates heat energy (for example, a heat generating resistor element) as energy to be utilized for ink ejection, and employs a method for causing a change in state of ink (film boiling) by the heat energy. This configuration achieves high-density and high-definition of image recording. The present disclosure is not limited to such a method that utilizes the heat energy, and may be a method that utilizes vibration energy with a configuration including a piezoelectric element.

Figure 5A:
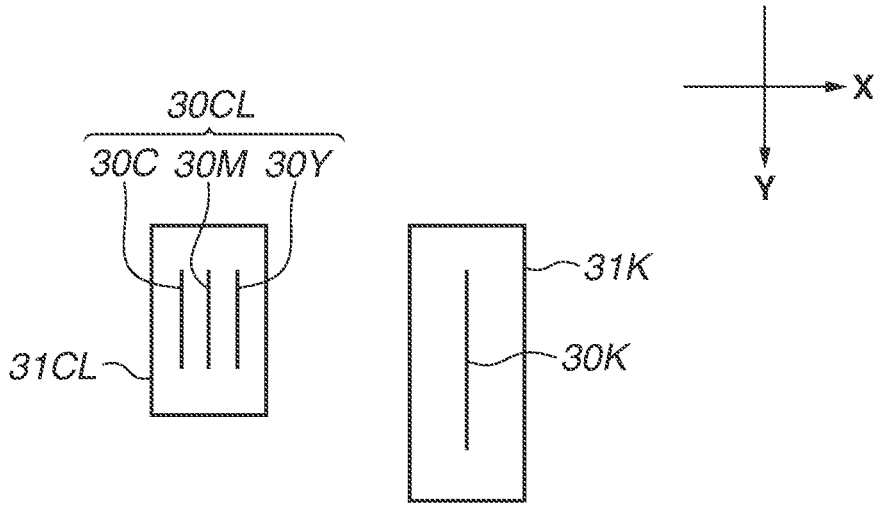
FIGS. 5A and 5B are schematic diagrams respectively illustrating ejection port surfaces of recording heads and caps corresponding to the respective ejection port surfaces, according to the first exemplary embodiment.

In the recording head 4, a plurality of ejection port arrays 30 that ejects ink is arranged on an ejection port surface 31 for respective colors (refer to FIG. 5A). A plurality of ink tanks 8 corresponding to ink ejected from respective recording heads 4 is fixed on the front surface side of the recording apparatus 50. Each ink tank 8 and a corresponding recording head 4 are connected to each other on a color-by-color basis by a supply tube 10 so that ink contained in the ink tank 8 is supplied to the recording head 4.

The ink tanks 8 include an ink tank for black 8K and an ink tank for color 8CL. The ink tank for black 8K is arranged on a left side (on the other side) of the recording apparatus 50 when viewed from the front surface. The ink tank for color 8CL includes an ink tank for cyan 8C, an ink tank for magenta 8M, and an ink tank for yellow 8Y, and is arranged on a right side (on one side) of the recording apparatus 50 when viewed from the front surface.

In addition, the recording apparatus 50 is provided with a tank cover for black 12Bk and a tank cover for color 12Cl. The tank cover for black 12Bk covers an upper surface of the ink tank for black 8K. Meanwhile, the tank cover for color 12Cl integrally covers upper surfaces of the ink tank for cyan 8C, ink tank for magenta 8M, and ink tank for yellow 8Y. The tank cover for black 12Bk and the tank cover for color 12Cl are hereinafter referred to as a tank cover 12.

FIGS. 2A to 2D are external perspective views of the ink tank 8 and its peripheral components. Since the ink tank 8 and the peripheral components are common to each ink color, the ink tank for black 8K will be described as an example with reference to FIGS. 2A to 2D.

Figure 2A:
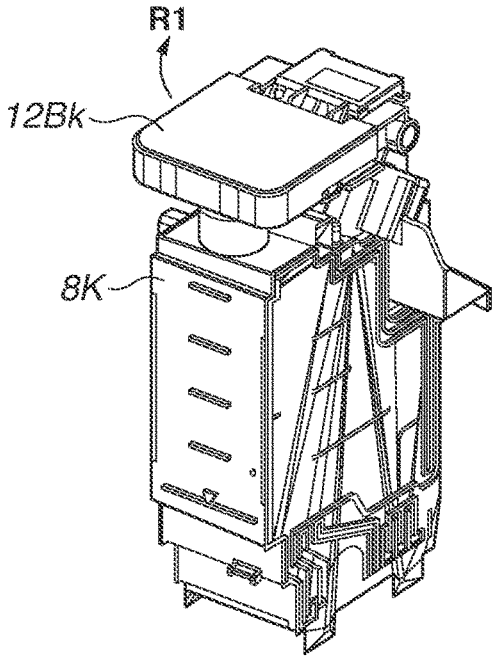
FIGS. 2A to 2D are external perspective views of an ink tank and its peripheral components according to the first exemplary embodiment.
Figure 2B:
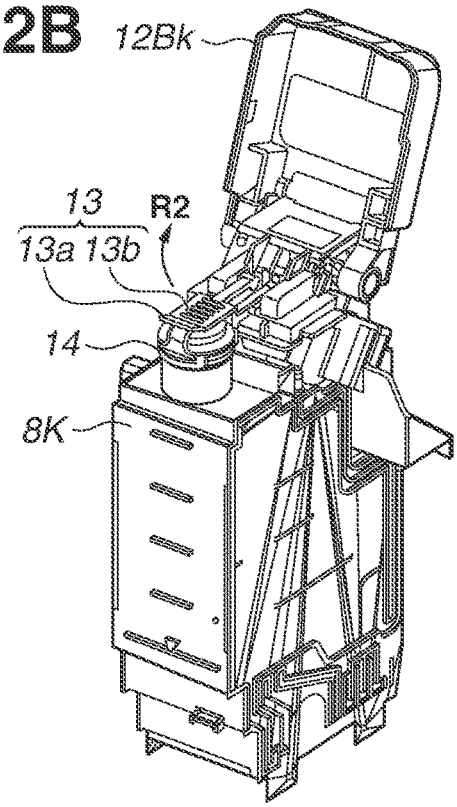
Figure 2C:
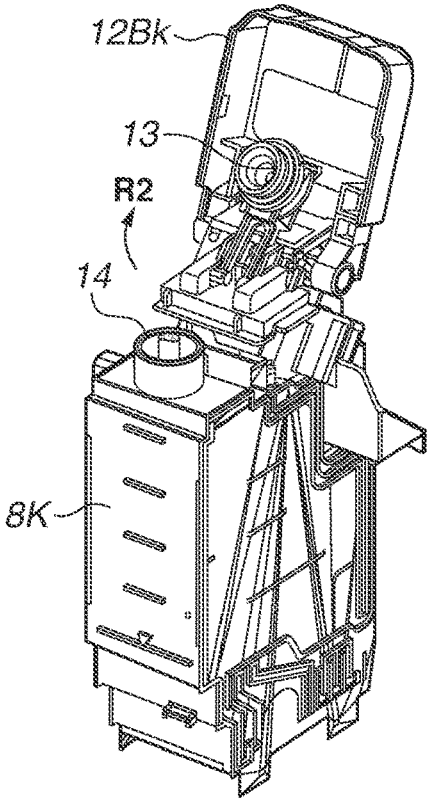

FIG. 2A illustrates a state in which the tank cover for black 12Bk is closed. FIG. 2B illustrates a state in which the tank cover for black 12Bk is open. By opening the tank cover for black 12Bk in an R1 direction, a user can access a tank cap 13.

A filling portion 14 for filling the ink tank for black 8K with ink is arranged on the upper surface of the ink tank for black 8K, and can be sealed with the tank cap 13. The tank cap 13 includes a cap portion 13*a* for sealing the filling portion 14 and a lever portion 13*b* that supports the cap portion 13*a* and that can be operated by a user. The lever portion 13*b* is supported about an axis so as to be pivotally movable with respect to the main body of the recording apparatus 50. A user can fill the ink tank for black 8K with ink by removing the cap portion 13*a* from the filling portion 14 while pivotally moving the lever portion 13*b* in an R2 direction illustrated in FIG. 2B (refer to FIG. 2C). The lever portion 13*b* may be supported about an axis so as to be capable of pivotally movable with respect to the ink tank for black 8K or the tank cover for black 12Bk.

The cap portion 13*a* of the tank cap 13 is made of a member having rubber elasticity, and the lever portion 13*b* is made of plastic or the like. The lever portion 13*b* of the present exemplary embodiment is color-coded in a color corresponding to a color of ink contained in the ink tank for black 8K. That is, the lever portion 13*b* for black ink is color-coded in black or gray, the lever portion 13*b* for cyan ink is color-coded in cyan, the lever portion 13*b* for magenta ink is color-coded in magenta, and the lever portion 13*b* for yellow ink is color-coded in yellow. With this configuration, a user can be prevented from filling the ink tank for black 8K with ink in a wrong color when filling the ink tank for black 8K with ink. A mode in which not only the lever portion 13*b* but also the cap portion 13*a* is color-coded may be employed.

Figure 2D:
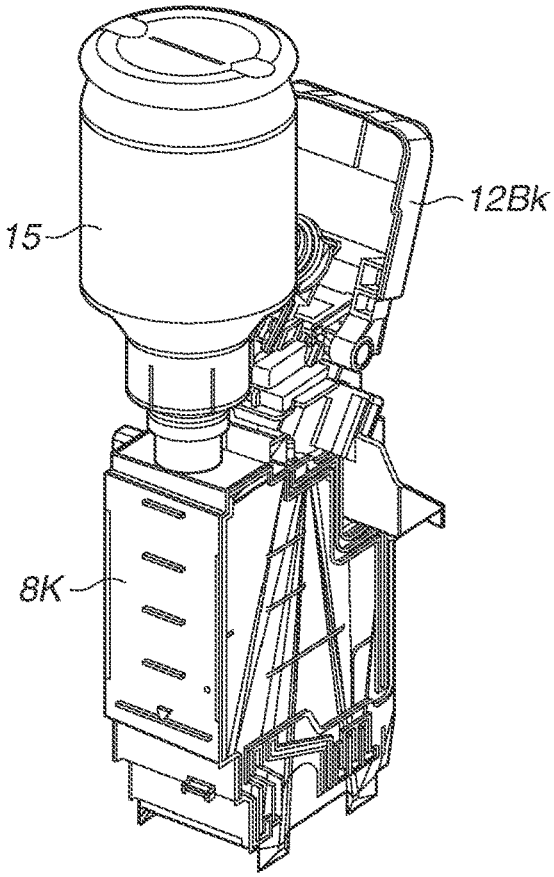

FIG. 2D illustrates how an ink bottle 15, which is an ink supplementing container, is inserted into the filling portion 14 to fill the ink tank for black 8K with ink, in a state in which the tank cap 13 is removed. In the present exemplary embodiment, gas-liquid exchange of ink in the ink bottle 15 with the air in the ink tank for black 8K causes the ink tank for black 8K to be filled with ink.

Figure 3:
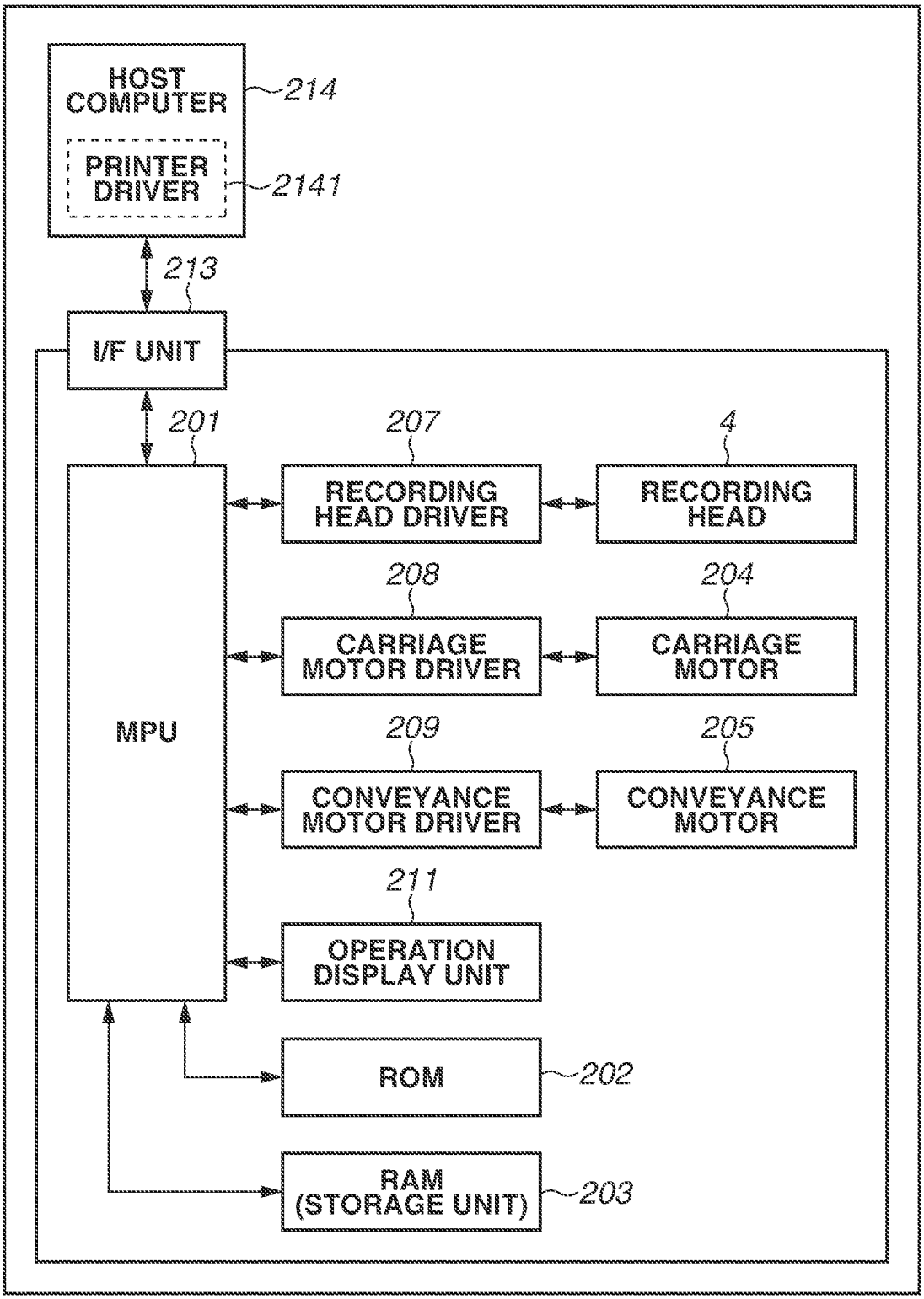
FIG. 3 is a block diagram illustrating a control system of the ink jet recording apparatus according to the first exemplary embodiment.

FIG. 3 is a block diagram illustrating a control system of the recording apparatus 50. A microprocessing unit (MPU) 201 controls the entire recording apparatus 50 to perform an operation of each unit, data processing, and the like. A read-only memory (ROM) 202 stores therein a program to be executed by the MPU 201, various kinds of data, and the like. A random-access memory (RAM) 203 temporarily stores therein processing data to be executed by the MPU 201 and data received by a host computer 214.

The recording head 4 is controlled by a recording head driver 207. A carriage motor 204 that drives the carriage 7 is controlled by a carriage motor driver 208. The conveyance roller 1 and a discharge roller are driven by a conveyance motor 205. The conveyance motor 205 is controlled by a conveyance motor driver 209.

The host computer 214 is provided with a printer driver 2141 that collects and organizes recording information, such as a recording image and recording image quality, to communicate with the recording apparatus 50 in a case where execution of a recording operation is instructed by a user. The MPU 201 executes exchange of a recording image or the like with the host computer 214 via an interface (I/F) unit 213. Furthermore, the recording apparatus 50 is provided with an operation display unit 211, with which a user can perform an operation, such as input of a command to the recording apparatus 50. The operation display unit 211 displays an error or the like that has occurred in the recording apparatus 50, thereby enabling notification of the error or the like to a user.

Figure 4:
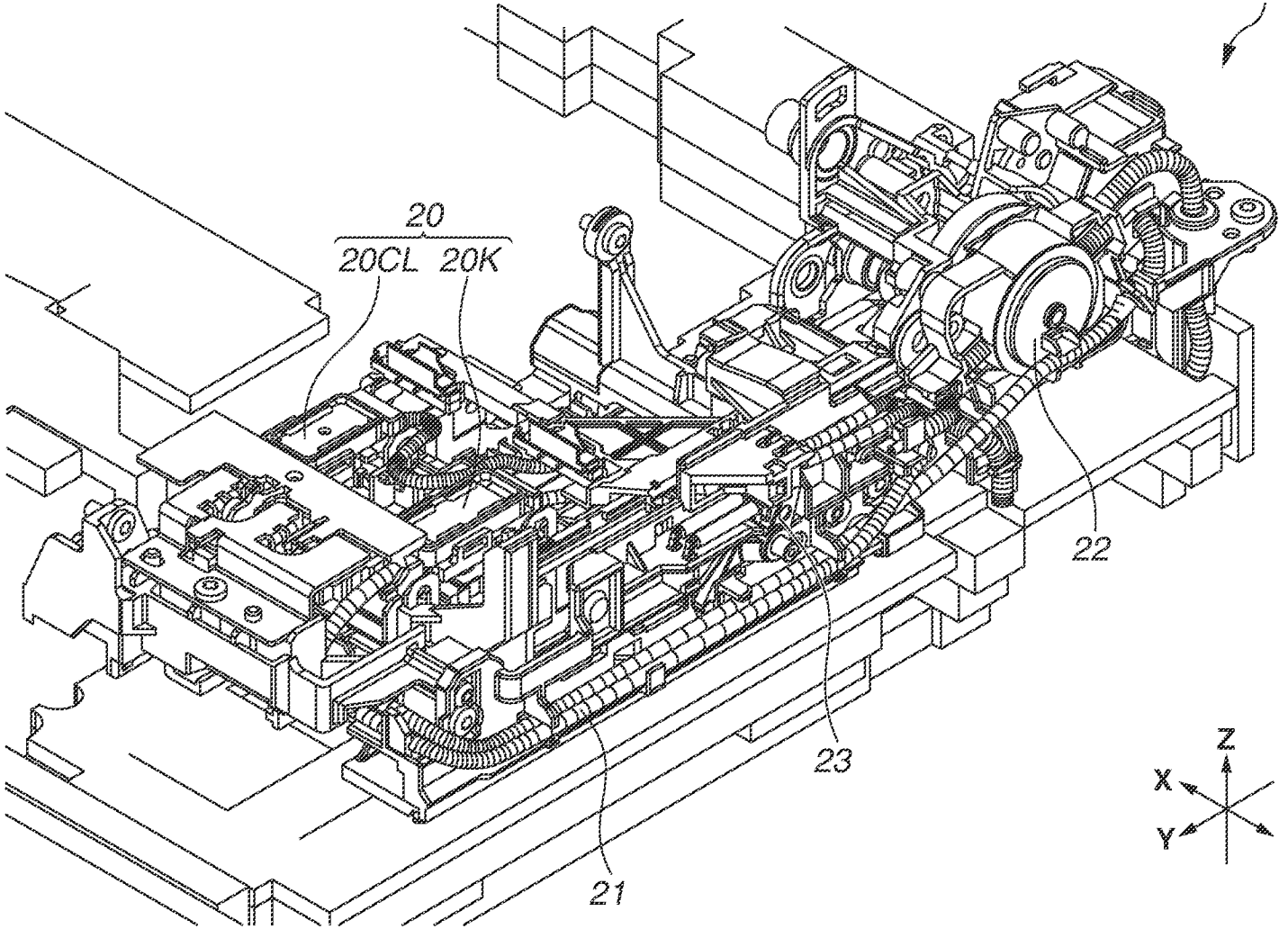
FIG. 4 is a perspective view illustrating a recovery unit according to the first exemplary embodiment.

FIG. 4 is a perspective view illustrating a recovery unit 11 arranged in the recording apparatus 50. The recovery unit (recovery means) 11 is a unit that performs a recovery operation necessary for maintaining ejection performance of the recording head 4. The recovery unit 11 is arranged in an area outside a recording area, in which recording is performed by the recording head 4. In the present exemplary embodiment, the recovery unit 11 is arranged on the right side when viewed from the front surface of the recording apparatus 50 and is nearer to the rear surface of the recording apparatus 50 than the ink tank for color 8CL is to the rear surface of the recording apparatus 50. The recovery unit 11 is arranged nearer to the ink tank for color 8CL than to the ink tank for black 8K. That is, in the main-scanning direction, the recovery unit 11 is arranged so that the recording area and the sheet discharge tray 6 can be arranged between the ink tank for black 8K and the ink tank for color 8CL.

The recovery unit 11 includes a cap 20 that caps the ejection port surface 31, a suction unit that sucks ink in the cap 20, an atmosphere communication valve 23 capable of switching an atmosphere communicating state in the cap 20 between a communicating state and a non-communicating state. The suction unit includes a tube for suction 21 that is connected to the cap 20 and a suction pump 22 that sucks ink in the cap 20 via the tube for suction 21. The sucked ink is discharged to a waste ink tank, which is not illustrated.

The cap 20 includes a cap for black 20K that caps an ejection port surface for black 31K of a recording head for black 4K, and a cap for color 20CL that caps an ejection port surface for color 31CL of a recording head for color 4CL. The atmosphere communication valve 23 includes an atmosphere communication valve for black 23K and an atmosphere communication valve for color 23CL (refer to FIG. 6). The atmosphere communication valve for black 23K switches between communication and non-communication between the cap for black 20K and the atmosphere. The atmosphere communication valve for color 23CL switches between communication and non-communication between the cap for color 20CL and the atmosphere.

Figure 5B:
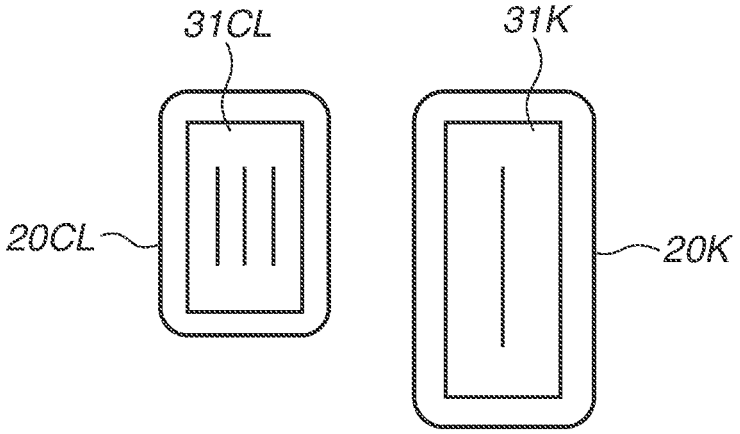

FIGS. 5A and 5B are schematic diagrams respectively illustrating the ejection port surfaces 31 and the caps 20 corresponding to the respective ejection port surfaces 31. FIG. 5A is a diagram illustrating each ejection port surface 31 when viewed from below. The recording head for black 4K that is connected to the ink tank for black 8K by the supply tube 10 is provided with an ejection port array for black 30K on the ejection port surface for black 31K. In addition, the recording head for color 4CL that is connected to the ink tank for color 8CL on a color-by-color basis by the supply tube 10 is provided with three ejection port arrays for color 30CL on the ejection port surface for color 31CL. The ejection port arrays for color 30CL include an ejection port array for cyan 30C, an ejection port array for magenta 30M, and an ejection port array for yellow 30Y.

FIG. 5B is a perspective view illustrating a state in which the ejection port surface 31 is capped by the cap 20 when viewed from above. In a standby state of not performing a recording operation, the recording head 4 is on standby above the recovery unit 11. The ejection port surface for black 31K is capped by the cap for black 20K, and the ejection port surface for color 31CL is capped by the cap for color 20CL. This configuration can prevent drying of ink in each ejection port array 30. The cap 20 is configured to infallibly cover the ejection port surface 31. Especially, on the ejection port surface for color 31CL, one cap for color 20CL is configured to cap three ejection port arrays.

Figure 6:
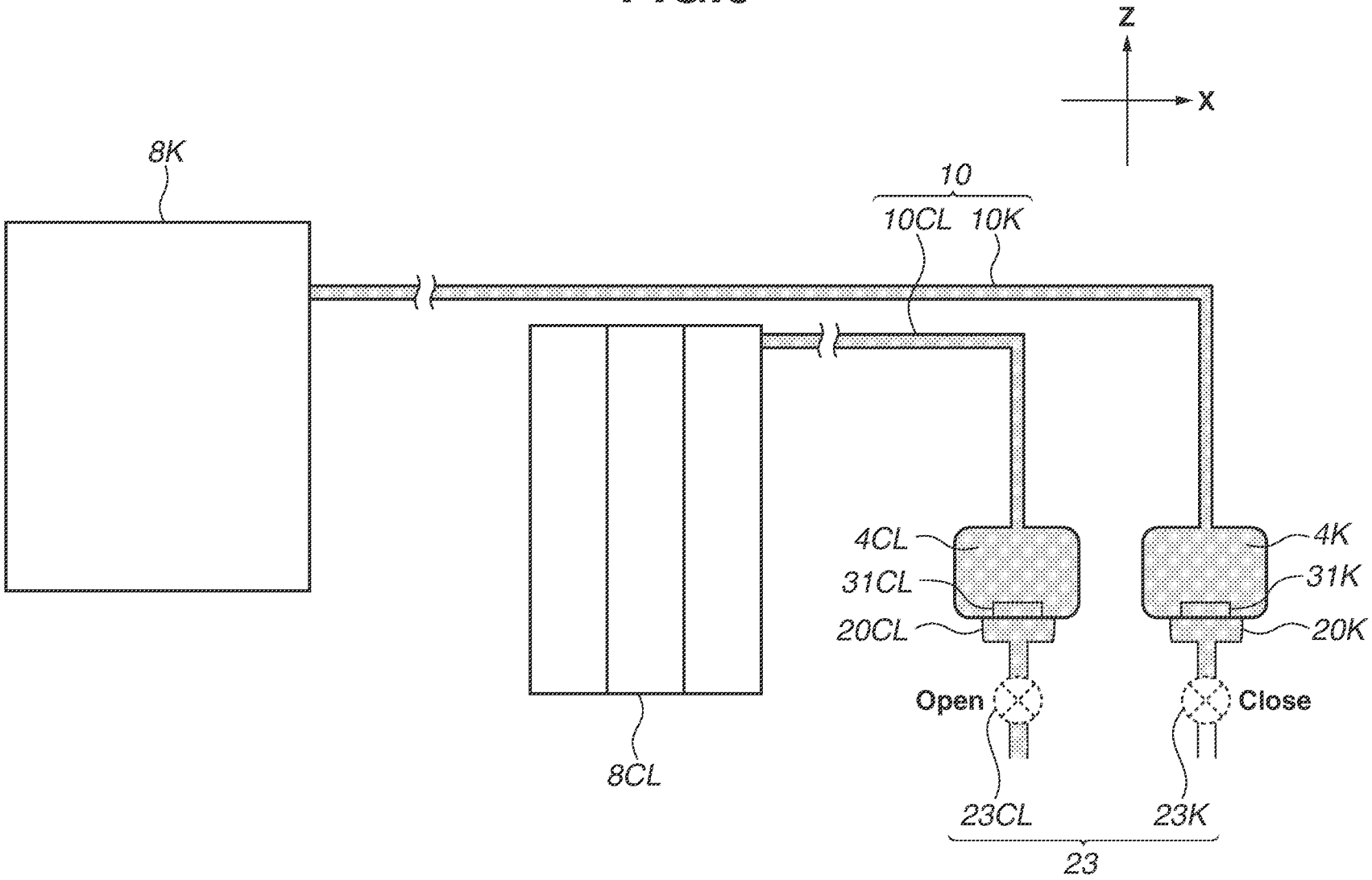
FIG. 6 is a schematic view illustrating states of the recording heads and caps at the time of transportation of the ink jet recording apparatus according to the first exemplary embodiment.
Figure 7:
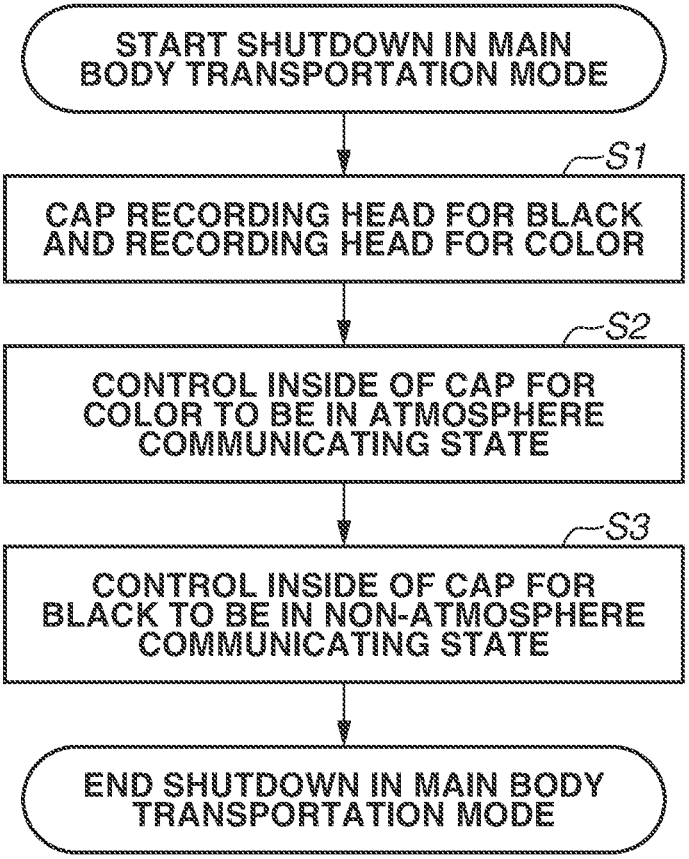
FIG. 7 is an operation flowchart of a main body transportation mode according to the first exemplary embodiment.

FIG. 6 is a schematic view illustrating states of the recording heads 4 and caps 20 at the time of transportation of the recording apparatus 50. FIG. 7 is an operation flowchart of a main body transportation mode. When a user inputs a shutdown instruction for executing the main body transportation mode to the recording apparatus 50 via the operation display unit 211 or the printer driver 2141, the reception of the instruction triggers the recording apparatus 50 to start the operation flow of the main body transportation mode. The main body transportation mode in this case is a mode for transporting the recording apparatus 50 to another location in a state in which the recording apparatus 50 has started to be used by the user and ink is contained in the ink tank 8.

In step S1, the ejection port surface for color 31CL is capped by the cap for color 20CL, and the ejection port surface for black 31K is capped by the cap for black 20K. Subsequently, in step S2, the atmosphere communication valve for color 23CL is opened so that the inside of the cap for color 20CL becomes the communicating state of communicating with the atmosphere. In step S3, the atmosphere communication valve for black 23K is closed so that the inside of the cap for black 20K becomes the non-communicating state of not communicating with the atmosphere. After the operations described above, the shutdown of the recording apparatus 50 is completed.

Figure 8A:
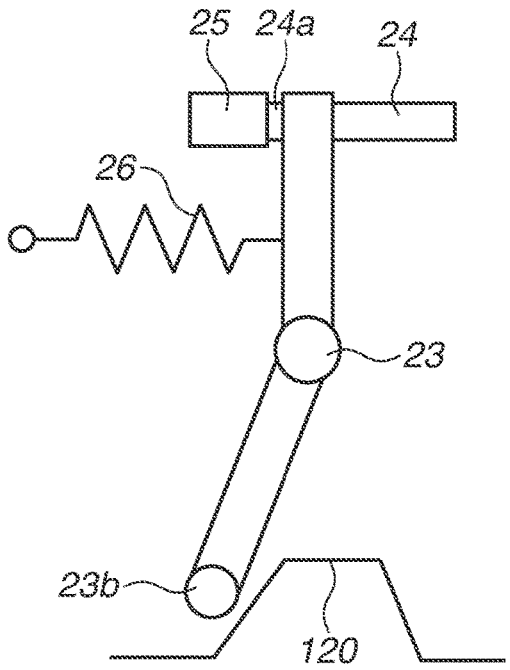
FIGS. 8A and 8B are schematic views each illustrating an operation of an atmosphere communication valve of the recovery unit according to the first exemplary embodiment.
Figure 8B:
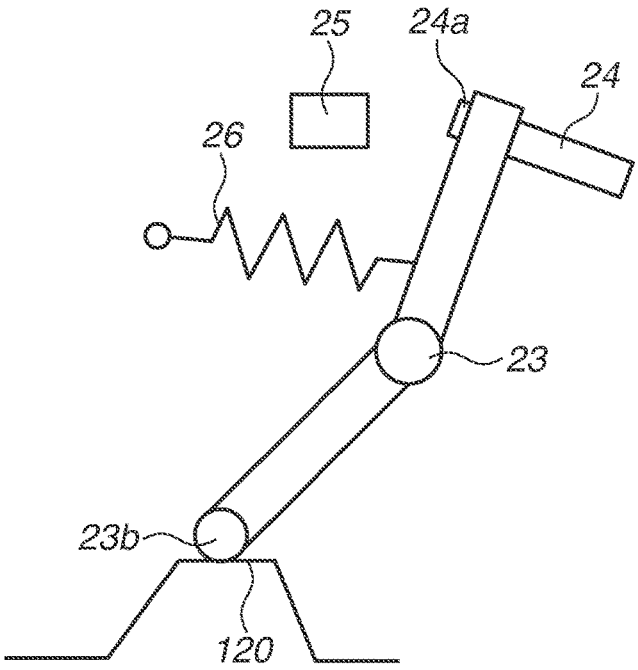

FIGS. 8A and 8B are schematic views each illustrating an operation of the atmosphere communication valve 23. FIG. 8A illustrates a state in which the atmosphere communication valve 23 is closed. FIG. 8A illustrates a state in which the atmosphere communication valve 23 is open. The atmosphere communication valve 23 is mounted in the recovery unit 11 so as to be pivotally movable. One end of the atmosphere communication valve 23 is connected to a tube for atmosphere communication 24 that is connected to the cap 20, and the other end thereof is provided with a cam follower 23*b* that is in sliding contact with a cam 120 that operates by being driven by the conveyance motor 205 as a driving source. In addition, the recovery unit 11 includes a seal member 25 and an urging member 26. The seal member 25 is capable of closing an opening portion 24*a* of the tube for atmosphere communication 24. The urging member 26 urges the atmosphere communication valve 23 in a direction in which the opening portion 24*a* and the seal member 25 come in contact with each other.

As illustrated in FIG. 8A, in a state in which the cam 120 and the cam follower 23*b* are not in contact with each other, the atmosphere communication valve 23 is urged by the urging member 26 in the direction in which the opening portion 24*a* and the seal member 25 come in contact with each other. This operation closes the tube for atmosphere communication 24, thereby bringing the cap 20 into the non-communicating state.

As illustrated in FIG. 8B, on the other hand, when the cam 120 and the cam follower 23*b* come in contact with each other, the atmosphere communication valve 23 resists an urging force of the urging member 26, and the opening portion 24*a* pivotally moves in a direction away from the seal member 25. This operation opens the tube for atmosphere communication 24, thereby bringing the cap 20 into the communicating state.

In the present exemplary embodiment, as illustrated in FIGS. 1 and 6, the ink tank for color 8CL is arranged on a side near the recovery unit 11, and the ink tank for black 8K is arranged on a side far from the recovery unit 11. At the time of transportation of the main body, there is a case where the recording apparatus 50 is held in a posture (for example, facing laterally) different from a posture when used as illustrated in FIG. 1. At this time, in a case where ink is contained in the ink tank 8, the larger a difference in height (surface level difference) between a liquid surface of contained ink and the ejection port surface 31 of the recording head 4 becomes, the more easily ink leaks from the ejection port array 30.

For example, in a case where the recording apparatus 50 is arranged with a side surface thereof on the recovery unit side (the right side surface when viewed from the front surface) facing downward in the X-direction, the recording apparatus 50 is brought into a state in which the ink tank for black 8K arranged on the left side surface when viewed from the front surface is at a high position. Consequently, a surface level difference between a liquid surface of ink contained in the ink tank for black 8K and the ejection port surface for black 31K is generated. In the present exemplary embodiment, however, since the cap for black 20K is controlled to be in the non-communicating state of not communicating with the atmosphere as described in step S3 in FIG. 7, an ink flow passage from the ink tank for black 8K to the ejection port array for black 30K is a closed space. With this configuration, even if the surface level difference is generated, application of pressure to the ejection port array for black 30K prevents leakage of ink.

Meanwhile, since the ink tank for color 8CL is arranged on the right side surface of the recording apparatus 50 similarly to the recovery unit 11, a surface level difference generated between the liquid surface of ink contained in the ink tank for color 8CL and the ejection port surface for color 31CL is smaller than the surface level difference generated in the case of black. Hence, as described with reference to step S2 in FIG. 7, even if the posture of the recording apparatus 50 is changed with the cap for color 20CL remaining in the atmosphere communicating state, ink hardly leaks from the ejection port array for color 30CL.

In addition, there is a case where the air in the cap expands and contracts due to a change in environment, such as change in temperature and humidity, during transportation of the recording apparatus 50. That is, when the cap 20 is held in the non-communicating state like the cap for black 20K, for example, there is a case where the air in the cap for black 20K contracts as a temperature decreases, and accordingly, ink is drawn out (leaks out) from the ejection port array for black 30K. Thereafter, as the temperature increases, the air in the cap for black 20K expands. As a result, a phenomenon in which the drawn ink is drawn back into the ejection port array for black 30K occurs.

In this case, since the cap for black 20K caps only the ejection port array for black 30K, mixture of ink colors never occurs even if black ink that has leaked out once is drawn back into the ejection port array for black 30K. In contrast, since the cap for color 20CL collectively caps the three ejection port arrays 30 corresponding to respective different three colors, the mixture of ink colors occurs if ink that has leaked out is drawn into the ejection port array for the other color.

In contrast, bringing the cap for color 20CL into the atmosphere communicating state prevents expansion and contraction of the air in the cap for color 20CL due to the change in environment, such as the change in temperature and humidity, and can thereby prevent occurrence of the mixture of colors as described above.

In this manner, in a case where the transportation mode is selected, the cap 20 covering the ejection port array 30 that ejects ink contained in the ink tank 8 located far from the recovery unit 11 is brought into the non-communicating state of not communicating with the atmosphere. In addition, the cap 20 covering the ejection port array 30 that ejects ink contained in the ink tank 8 located near the recovery unit 11 is brought into the communicating state of communicating with the atmosphere. This configuration can prevent mixture of ink colors in the cap 20 while reducing leakage of ink from the cap 20.

Figure 9:
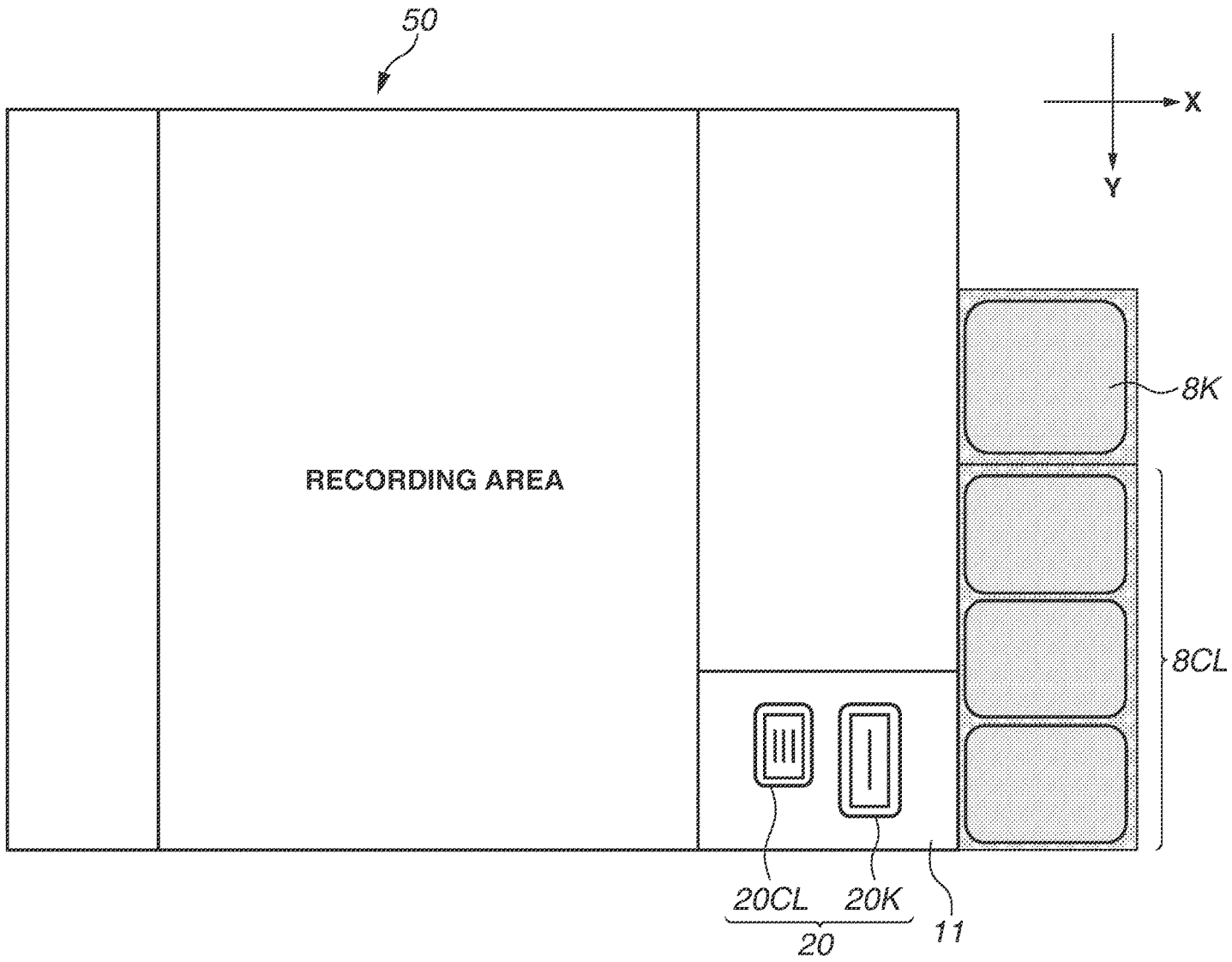
FIG. 9 is a top surface schematic diagram illustrating arrangements of ink tanks according to a second exemplary embodiment.

FIG. 9 is a top surface schematic diagram illustrating arrangements of the ink tanks 8 according to a second exemplary embodiment. In the first exemplary embodiment, the description has been given of the configuration in which the ink tank for black 8K and the ink tank for color 8CL are arranged to be separate from each other in the main-scanning direction in which the carriage 7 moves. In the second exemplary embodiment, the ink tank for color 8CL is arranged near the recovery unit 11 (cap 20) and the ink tank for black 8K is arranged far from the recovery unit 11 (cap 20), in the conveyance direction (Y-direction) of a recording medium. The recording apparatus 50 having such arrangements of the ink tanks 8 can also provide advantageous effects similar to those of the first exemplary embodiment by performing control of the transportation mode similarly to the first exemplary embodiment.

Figure 10A:
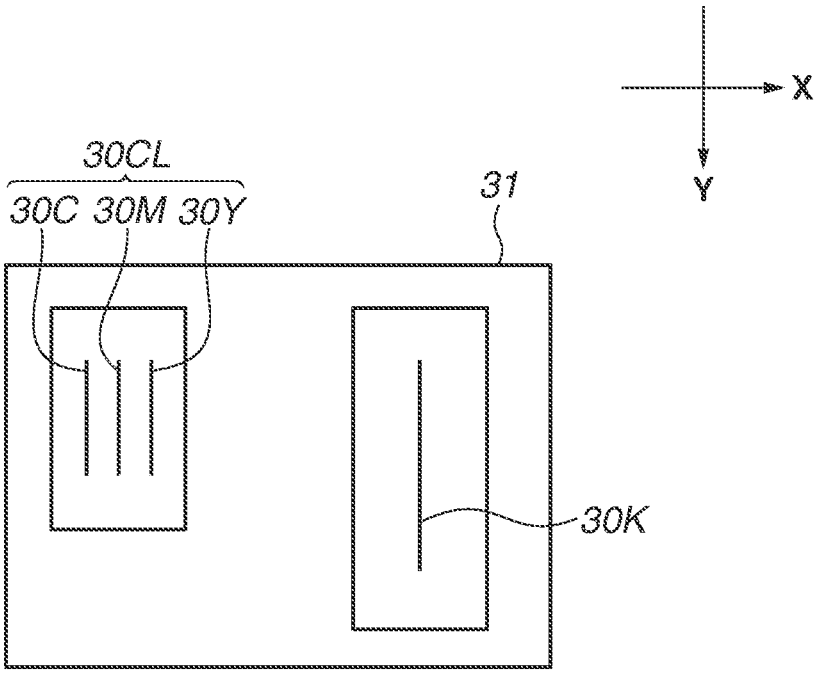
FIGS. 10A and 10B are schematic diagrams respectively illustrating an ejection port surface of a recording head and a cap corresponding to the ejection port surface, according to a third exemplary embodiment.
Figure 10B:
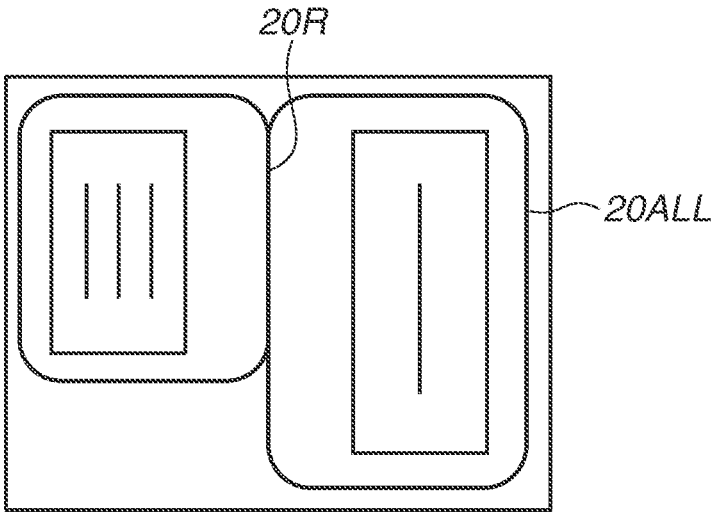

FIGS. 10A and 10B are schematic diagrams respectively illustrating the ejection port surface 31 and the cap corresponding to the ejection port surface 31 according to a third exemplary embodiment. FIG. 10A is a diagram illustrating the ejection port surface 31 when viewed from below. In the third exemplary embodiment, a description will be given of an example in which one recording head 4 is provided with both the ejection port array for black 30K and the ejection port array for color 30CL.

FIG. 10B is a perspective view illustrating a state in which the ejection port surface 31 is capped by the cap 20 when viewed from above. The third exemplary embodiment includes an all-in-one cap 20 ALL capable of integrally capping both the ejection port array for black 30K and the ejection port array for color 30CL so as to have a configuration corresponding to the configuration of the recording head 4. To prevent mixture of black ink discharged from the ejection port array for black 30K and color ink discharged from the ejection port array for color 30CL, the all-in-one cap 20 ALL is provided with a rib 20R serving as a partition therebetween and is thus partitioned.

In this manner, also in a case of arranging the all-in-one cap 20 ALL, arranging the atmosphere communication valve 23 that switches the communicating state of communicating with the atmosphere for each space that is partitioned by the rib 20R enables execution of control similar to the control according to the first exemplary embodiment.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2020-147155, filed Sep. 1, 2020, which is hereby incorporated by reference herein in its entirety.

What is claimed is:

1. A recording apparatus, comprising:

a first recording head including a first ejection port array configured to eject a first liquid;

a second recording head including a second ejection port array configured to eject a second liquid;

a recovery unit including a first cap configured to cap the first ejection port array and a second cap configured to cap the second ejection port array;

a first tank configured to contain the first liquid to be supplied to the first ejection port array;

a second tank that is arranged farther from the recovery unit than the first tank is to the recovery unit and that is configured to contain the second liquid to be supplied to the second ejection port array;

a first atmosphere communication valve configured to switch a communicating state between an inside of the first cap and an atmosphere;

a second atmosphere communication valve configured to switch a communicating state between an inside of the second cap and an atmosphere; and a control unit configured to, in a case where an instruction to transport the recording apparatus is input, perform control of opening the first atmosphere communication valve and bringing the inside of the first cap into a communicating state of communicating with the atmosphere, and perform control of closing the second atmosphere communication valve and bringing the inside of the second cap into a non-communicating state of not communicating with the atmosphere.

2. The recording apparatus according to claim 1, further comprising:

a first tube configured to connect the first tank and the first recording head to each other; and a second tube configured to connect the second tank and the second recording head to each other.

3. The recording apparatus according to claim 1, wherein the first cap and the second cap are integrally formed, and partitioned therebetween by a partition.

4. The recording apparatus according to claim 1, wherein the first tank includes a first filling portion configured to fill an inside of the first tank with the first liquid, and wherein the second tank includes a second filling portion configured to fill an inside of the second tank with the second liquid.

5. The recording apparatus according to claim 1, further comprising a carriage, on which the first recording head and the second recording head are mounted, and that is configured to move in a main-scanning direction, wherein, in the main-scanning direction, the recovery unit and the first tank are arranged on one side of the recording apparatus, and the second tank is arranged on the other side.

6. The recording apparatus according to claim 5, wherein, in the main-scanning direction, the first tank and the second tank are arranged so that a recording area, in which the first recording head and the second recording head perform recording, is interposed between the first tank and the second tank.

7. The recording apparatus according to claim 1, further comprising a conveyance unit configured to convey a recording medium in a conveyance direction to a recording position facing the first recording head and the second recording head, wherein the second tank is arranged to be separate from the recovery unit and the first tank in the conveyance direction.

8. The recording apparatus according to claim 1, wherein the first liquid is color ink, and the second liquid is black ink.

9. The recording apparatus according to claim 8, wherein the color ink includes cyan ink, magenta ink, or yellow ink.

10. The recording apparatus according to claim 1, wherein the first recording head includes a third ejection port array configured to eject a third liquid, and wherein the first cap is configured to cap the first ejection port array and the third ejection port array.

11. The recording apparatus according to claim 10, wherein the first recording head includes a fourth ejection port array configured to eject a fourth liquid, and wherein the first cap is configured to cap the first ejection port array, the third ejection port array, and the fourth ejection port array.

* * * * *